US007687692B2

(12) United States Patent
Clark et al.

(10) Patent No.: US 7,687,692 B2
(45) Date of Patent: Mar. 30, 2010

(54) HAMMER SHANK AND SHANK BUTT FOR PIANO

(75) Inventors: Bruce E. Clark, Nottingham, NH (US); Kevin Burke, Haverhill, MA (US); Kirk Burgett, Sacramento, CA (US)

(73) Assignee: Wessell, Nickel & Gross, Sacramento, CA (US)

( * ) Notice: Subject to any disclaimer, the term of this patent is extended or adjusted under 35 U.S.C. 154(b) by 0 days.

(21) Appl. No.: 12/013,330

(22) Filed: Jan. 11, 2008

(65) Prior Publication Data

US 2009/0178534 A1 Jul. 16, 2009

(51) Int. Cl.
*G10C 3/00* (2006.01)

(52) U.S. Cl. ..... 84/216

(58) Field of Classification Search ..... 84/216–224, 84/199, 174

See application file for complete search history.

(56) References Cited

U.S. PATENT DOCUMENTS 4,846,039 A * 7/1989 Mosher ..... 84/293

2005/0045016 A1* 3/2005 Yoshisue ..... 84/251

FOREIGN PATENT DOCUMENTS

JP 2005099610 A * 4/2005

* cited by examiner

*Primary Examiner*—Kimberly R Lockett
(74) *Attorney, Agent, or Firm*—Craig A. Simmermon

(57) ABSTRACT

A hammer shank and a separate shank butt component for a grand piano hammer assembly with increased rigidity, reduced inertia, and the collateral benefits of increased efficiency of manufacture and maintenance. Hammer shank comprises a long cylindrical member that is connected at one end to a traditional grand piano hammer and at the other end to a novel shank butt. Shank butt comprises: a hammer shank hole, a knuckle slot, a set of two flange attachment holes, and a void area. A traditional grand piano knuckle is attached to the knuckle slot. The shank butt is connected to the repetition flange of the piano. The invention provides the capability for a piano to be played with less touch weight on the keys and therefore provides a more responsive piano keyboard. The invention also allows for full "retrofitability" of hammer assembly into all existing grand piano brands. Embodiments include a composite shank butt that is a molded article and a composite hammer shank that is an extruded or molded article.

5 Claims, 7 Drawing Sheets

HAMMER SHANK AND SHANK BUTT FOR PIANO

BACKGROUND OF INVENTION

This invention relates to key operated percussion devices such as pianos and, more specifically, to the hammer assemblies of such devices. A hammer assembly according to this invention comprises a hammer 40, hammer shank 30, shank butt 20, and knuckle 240.

A piano produces sound as a result of a complicated mechanical chain reaction which starts with the pianist depressing a piano key which in turn actuates a piano action associated with the key which in turn rotates a hammer assembly associated with the piano action which in turn strikes a piano string or strings to make sound.

More specifically, a depressed key 10 gives rise to motion of the damper head assembly (not shown), separating the damper head from the associated set of strings 35, setting the strings ready to accept vibrations. The depressed key 10 also actuates the piano action 15 thereby pushing or "throwing" the associated hammer 40 and hammer shank 30 into the associated set of strings or string 35. The hammer 40 strikes the strings, generating a piano tone. The piano action 15 then receives or "catches" the hammer 40 and hammer shank 30 after it strikes the strings 35 and rebounds back against the action 15. When the pianist releases the depressed key 10, the key 10 returns to the rest position, and permits the damper head assembly to return contact with the vibrating strings 35. The vibrations are absorbed by the damper head assembly, and the piano tone is terminated.

With a grand piano 45, a certain amount of kinetic energy is required when depressing a key 10 in order to move a hammer 40 as imparted by the piano action 15 to the integrated hammer shank (20 and 30). When a key 10 is depressed, the repetition base 70 is pushed upward pivotally about the repetition flange 90. The jack 50 is simultaneously moved upward pivotally about point 100 in the clockwise direction and pivotally about repetition flange 90 in the counterclockwise direction, resulting in a general upward motion. The jack 50 lifts the balancier 60, which also moves upward from double pivot motion, this time about the repetition flange 90 and point 110. The jack 50 raises the knuckle 80 along with the integrated hammer shank (20 and 30) thereby lifting the hammer 40 upwards towards the piano strings 35. The knuckle 80 also slides along the guide surface of the balancier 60. These both cause the hammer 40 to move upward by rotation about point 105 towards the set of horizontally stretched strings or string 35 associated with that key 10. The hammer 40 moves with "free rotation" powered by the knuckle 80 sliding along the balancier 60. The hammer shank 30 is further rotated and disconnects from the balancier 60 in order for the hammer 40 to strike the strings 35.

Likewise, with an upright piano 115, a certain amount of kinetic energy is required when depressing a key 10 in order to move a hammer 40 as imparted by the piano action 15 to the shank butt 20 and hammer shank 30. As the key 10 is depressed, the wippen 120 is pushed up to pivotally move upward, causing the jack 130 to move up together with the wippen 120. The jack 130 is pivotally arranged on the wippen 120. The hammer 40 is then pushed up by the jack 130 through the shank butt 20, and pivotally moves toward a set of vertically stretched strings or string 35. Then, as the jack 130 comes into contact with a regulating button 140, the jack 130 is prevented from moving up and loses contact with the shank butt 20. The hammer 40 and hammer shank 30 continue to move upwards, without contact with the jack 130, and are thus thrown into the string or strings 35 to create piano tone.

At this point, on both grand pianos and upright pianos, conventional wooden hammer shanks 30 bend somewhat before whipping around to strike the strings. This phenomenon can be verified by simple high speed photography of hammer motion resulting from practically every instance of piano playing. The more virtuosic the particular piano piece played, the greater the bending or deflection of the hammer shanks 30. This is because virtuosic piano pieces require greater key depression strength with faster key depression repetitions, which results in more forceful and more frequent hammer assembly rotations. As with all deflection motion, the greater the force applied on the body, the greater the deflection.

Since the energy absorbed by a bending of hammer shank 30 does not directly translate into the production of music, it is wasted energy or energy loss of the system. Thus, more key depression energy is required in order to produce music as a result of the bending of a hammer shank 30. Therefore, the elimination of hammer shank 30 deflection lowers the threshold energy requirement for the creation of sound. Hence the elimination of hammer shank 30 deflection results in a more responsive piano that requires less touch weight on the keys to play the piano.

The grand piano prior art consists of an integral shank butt 20 and hammer shank 30, hereafter known as an "integrated hammer shank", made of wood, typically hornbeam or maple wood. The prior art does not consist of separate shank butt 20 and hammer shank 30 components. Prior art hammer shanks 30 come in one standard diameter or cross sectional area that can be thinned to reduce mass. The reduced mass is particularly required in the treble section because of the need to make the hammer rebound more quickly from the string. Prior art hammer shanks 30 are thinned on an increasing basis gradually as the pitch of the string or strings 35 associated with the particular hammer shank increases. For manufacturing efficiency, this thinning is not continuous but rather is stepped by three separate groups—"thin", "medium", and "thick". "Thick" hammer shanks are not trimmed at all and are used on the bass end of the piano. Hammers 40 are glued onto the hammer shank end of the integrated hammer shank (20 and 30). The integrated hammer shank (20 and 30) is connected to a hammer shank flange 95 by a center pin. The shank flange 95 is attached to the shank rail on the piano. The deflection referenced above occurs in the integrated hammer shank (20 and 30).

The applicants have conducted experimental analysis on grand piano integrated hammer shanks (20 and 30) made of hornbeam wood in order to determine their average rigidity. An integrated hammer shank (20 and 30) was clamped tight and secure on the shank butt end while weight was applied at 4.00" from the clamping point. A 4" effective length was used as this length is typical for grand piano integrated hammer shanks (20 and 30). Deflection 250 was measured at 3.79" from the clamping point. Deflection 250 from various weights was recorded. See FIG. 3 for a depiction of the setup used to quantify the rigidity of the prior art integrated hammer shanks (20 and 30). The results of the deflection experiment are summarized in the table below.

Prior Art Integrated Hammer Shank Rigidity Test

| Weight Applied (lbs) | "Thick" HB Average Deflection (inches) | "Medium" HB Average Deflection (inches) | "Thin" HB Average Deflection (inches) |
|---|---|---|---|
| 0 | 0 | 0 | 0 |
| 1.0 | 0.066 | 0.060 | 0.075 |
| 2.0 | 0.132 | 0.119 | 0.151 |
| 3.0 | 0.196 | 0.177 | 0.230 |
| 4.0 | 0.263 | 0.240 | 0.311 |

-continued

| Weight Applied (lbs) | "Thick" HB Average Deflection (inches) | "Medium" HB Average Deflection (inches) | "Thin" HB Average Deflection (inches) |
|---|---|---|---|
| 5.0 | 0.333 | 0.307 | 0.391 |
| 6.0 | 0.412 | 0.347 | 0.473 |

The relationship is linear, i.e. deflection 250 varies linearly in relation to the change in weight applied. Thus, the degree of deflection, which is inversely proportional to rigidity, of the integrated hammer shank (20 and 30) may be represented by a constant. In this case, the constant is given in the units of inches of deflection 250 per pound of weight applied and is determined by dividing the deflection number by the weight number listed above. The degree of deflection 250, defined as "deflectability", of the hornbeam integrated hammer shank (20 and 30) going form thick, medium, to thin is 0.066 in/lbs, 0.060 in/lbs, and 0.077 in/lbs respectively. The standard deviation of these measurements is less than 0.0015 in/lbs in all cases. Note the smaller the deflectability measurement, the greater the rigidity of the integrated hammer shank (20 and 30). Also note that hornbeam wood has greater specific gravity than that of maple wood and is, thus, more rigid than maple wood. Therefore, hornbeam integrated hammer shanks (20 and 30) are more rigid than their maple counterparts.

The complicated mechanical chain reaction required to strike piano strings deeply affects the music generated by the piano. With most string instruments, the musician touches the strings directly with his hand or directly through a non-dynamic instrument such as a pick or a bow. Conversely, the pianist must depend on a series of mechanical actions, assembled from many small parts, to strike the strings. A pianist varies the speed, force, repetition, acceleration, timing, and other characteristics in near endless combinations when depressing and releasing keys in order to produce various piano tones to yield artistic piano music.

The preferred "feel" of a piano action has come into acceptance more from tradition rather than from methods associated with modern engineering and material science. In the early 1900's, manufacturers used the best available materials at the time, to practically produce high quality piano actions. Hardwood and felt were the primary materials used to produce piano actions at that time. For better or for worse, pianists, to this day, strongly prefer wood/felt actions simply because they deliver the feel consistent with what they grew up with, leading to the propagation of more wood/felt actions, leading to newer generations of pianists learning to play on wood/felt actions, leading to the same preference with new generations, and so on.

Relative to more modern materials, such as composites or plastics, wood is an inefficient raw material from which to manufacture piano action components. Wooden action pieces must be drilled to produce the holes required for pivotal connections and assembly with other action components. The hole-drilling process is a laborious and costly process as compared to the production of molded piano action pieces with holes accurately formed therein during the initial molding process. Also, the production of any finished wooden piece necessarily involves relatively large quantities of wasted material in the form of saw dust, which is inefficient and wasteful.

Wood is hydroscopic, i.e. wood swells or shrinks as its moisture content changes in response to the environmental. This can cause binding in the action. Additionally, after repeated occurrences, this causes compression of the wood leading to failure of the piano action component. For instance, wooden flanges often crack due to expansion from a rise in moisture content, as the screw crushes the wood in the flange where it is fastened to the rail.

Moreover, wood has different strengths in different directions, complicating manufacturing processes, also resulting in reduced manufacturing efficiencies. Additionally, wood has inferior rigidity and strength as compared to modern composites and plastics. In particular, rigidity and strength is of the utmost importance to the hammer assembly portion of the complicated mechanical chain reaction of a piano.

Finally, the lifespan of wooden piano action components is limited as compared to that of other materials such as composites or plastics because wood eventually crumbles into dust after a certain amount of environmental cycles. On the other hand, composite piano action components would have several times the life span of that of their wood counterparts and thus result in more efficient manufacture and maintenance of a piano.

OBJECT OF INVENTION

It is an object of this invention to provide a new hammer assembly for a piano that requires less initial energy from the pianist's fingers in order to deliver the same sound of that generated by currently available traditional wooden hammer assemblies. This can be accomplished by the elimination or substantial reduction of hammer assembly deflection, without increasing the weight of the hammer assembly. Thus, it is an object of this invention to yield an improved hammer assembly with substantially increased stiffness or rigidity that can be retrofitted into any existing piano, thereby effectively providing a more responsive keyboard that requires less touch weight to play.

Additionally, it is an object of this invention to yield a hammer assembly with the collateral benefits of increased efficiency of manufacture and maintenance over those of their corresponding wood counterparts. Thus, it is an object of this invention to yield a more rigid hammer assembly with the additional benefits of increased efficiency of manufacture and maintenance.

DEFINITION LIST

Figure 1:
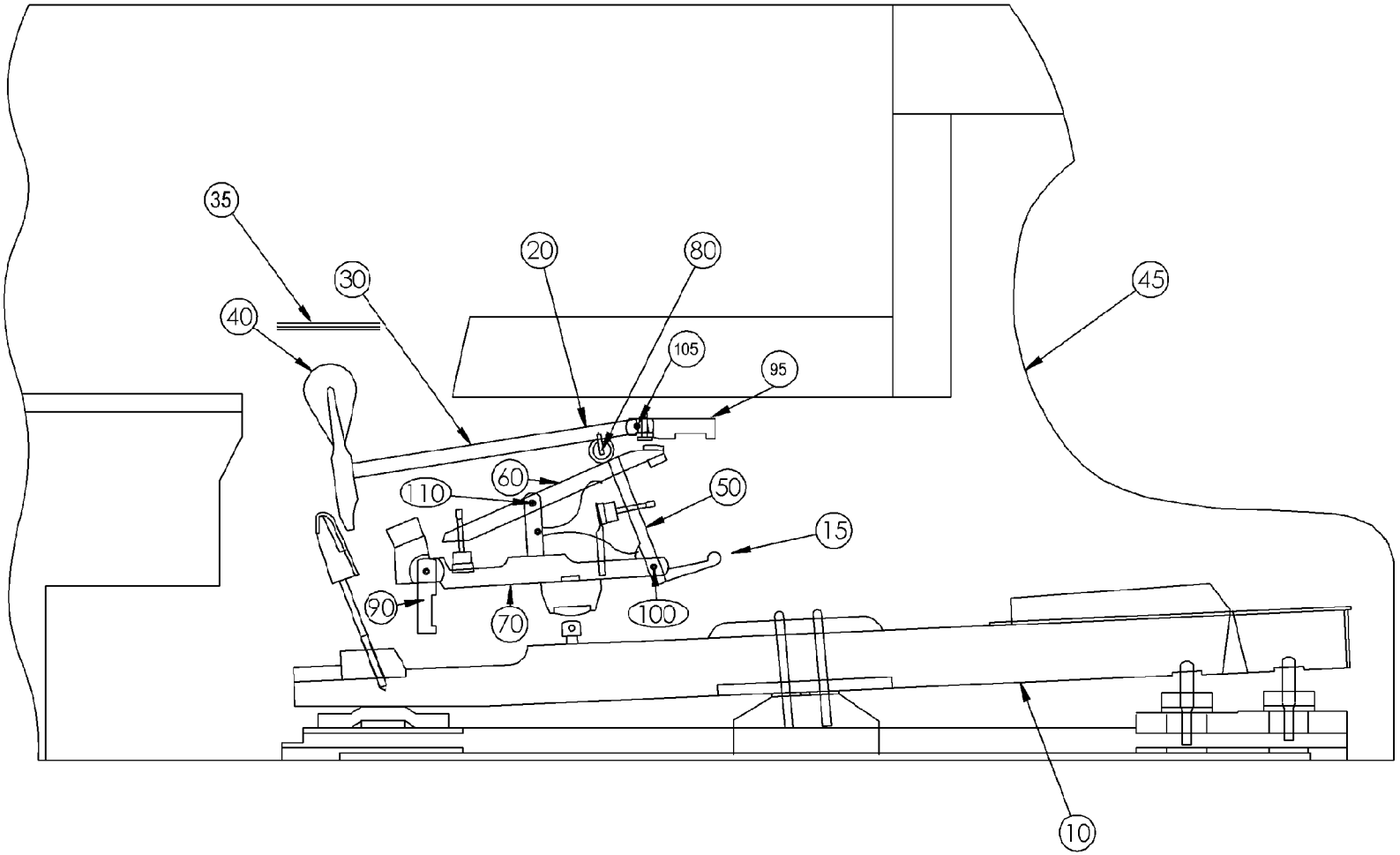
Prior Art Fig. 1
FIG. 1 is a cross sectional view of a generic grand piano.
Figure 2:
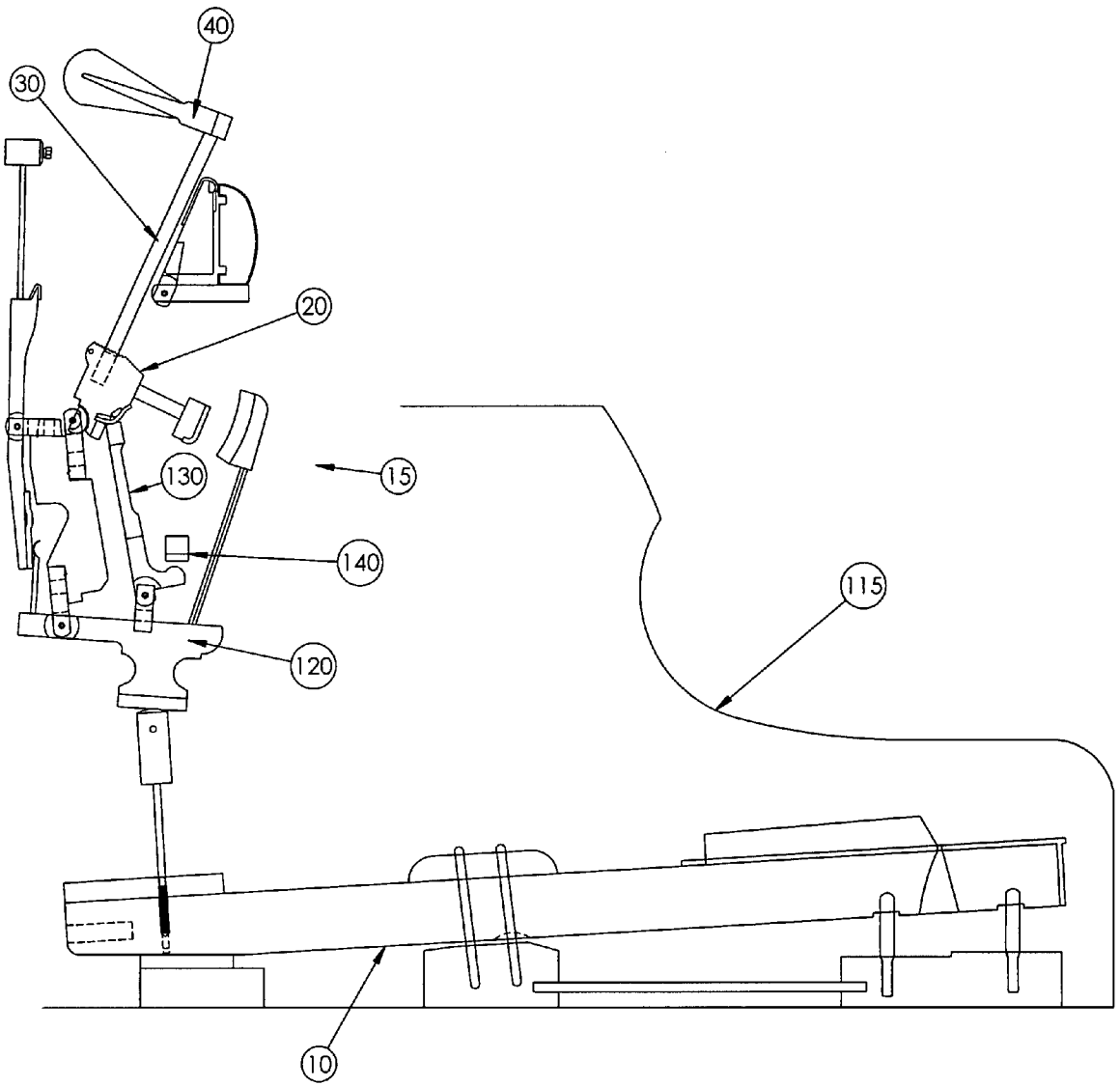
Prior Art Fig. 2
FIG. 2 is a cross sectional view of a generic upright piano.

| Term | Definition |
|---|---|
| 10 | Piano Key |
| 15 | Piano Action |
| 20 | Shank Butt |

-continued

| Term | Definition |
|---|---|
| 30 | Hammer Shank |
| 40 | Hammer |
| 45 | Grand Piano |
| 50 | Grand Piano Jack |
| 60 | Grand Piano Balancier |
| 70 | Grand Piano Repetition Base |
| 80 | Grand Piano Knuckle (prior art) |
| 90 | Grand Piano Repetition Flange |
| 95 | Grand Piano Shank Flange |
| 100 | Grand Piano Jack Pivot Point |
| 105 | Grand Piano Hammer Pivot Point |
| 110 | Grand Piano Balancier Pivot Point |
| 115 | Upright Piano |
| 120 | Upright Piano Wippen |
| 130 | Upright Piano Jack |
| 140 | Upright Piano Regulating Button |
| 150 | Shank Butt Center-to-Center Distance |
| 160 | Shank Butt Protrusion |
| 170 | Knuckle Diameter |
| 180 | Shank Butt Lower Lever Arm |
| 190 | Knuckle Slot on Shank Butt |
| 200 | Hammer Shank Hole on Shank Butt |
| 210 | Hollow Center of Best Mode Hammer Shank |
| 220 | Flange Attachment Holes on Shank Butt |
| 230 | Hollow Area on Shank Butt |
| 240 | Knuckle on Shank Butt |
| 250 | Deflection Amount |

DETAILED DESCRIPTION

A hammer assembly consists of a hammer 40, a hammer shank 30, a shank butt 20, and a knuckle 240. This invention includes novel hammer shanks 30 and novel shank butts 20 that can be attached to prior art hammers 40 and prior art knuckles 240, which are both made of wood and felt, typically hornbeam wood and felt. The novel hammer shanks 30 and novel shank butts 20 can be installed into any piano, both grand and upright pianos.

A grand piano shank butt 20 has two flange attachment holes 220, which are used to install a hinge pin in order to create a pivotal connection to a shank flange 95. A grand piano shank butt 20 also includes a hollow area 230, which is necessary to allow clearance for the shank butt 20 to pivotally rotate about the shank flange 95.

More than one diameter hammer shank 30 is used in a typical piano. Thus, the invention includes separately designed shank butts 20, each with an appropriated sized hole 200, to accept the various hammer shank 30 diameters in the public domain. In addition, the invention includes separately designed shank butts 20, each with an appropriately sized hole 200, to accept the various new hammer shank 30 diameters incorporated in this invention.

A grand piano shank butt 20 is affixed to a knuckle 240. The knuckle 240 transmits energy from the upward moving jack 50 to the knuckle 240 mounted on the shank butt 20. The knuckle 240 is attached to the shank butt 20 at the knuckle slot 190 and is typically attached by glue. The knuckle 240 is of traditional type, made of buckskin or synthetic buckskin with a resilient core. As the jack 50 moves upwards as the result of a keystroke, the knuckle 240 also moves upwards, thereby pushing the shank butt 20 upwards, which in turn pushes the hammer shank 30 upwards.

The leverage applied to the hammer assembly of a grand piano may be adjusted according to certain criteria of the shank butt 20. These criteria are shank butt center-to-center 150, shank butt protrusion 160, knuckle diameter 170, and shank butt lower lever arm vector dimension 180. Center-to-center 150 is varied by adjusting the location of the knuckle slot 190 on the shank butt 20. Protrusion 160 is varied by adjusting the knuckle diameter 170. Together, these two criteria determine the shank butt lower lever arm 180. Typically, different brands of piano require specific shank butt center-to center sizes 150 and specific shank butt protrusion sizes 160. This invention includes shank butts with all center-to-center sizes 150 and protrusion sizes 160 to fit any grand piano in the public domain.

All shank butts 20 of this invention are made of composite material or plastic material. Composite is defined as an engineered material made from two or more constituent materials with significantly different physical or chemical properties and which remain separate and distinct on a macroscopic level within the finished structure. Composites and plastics yield advantages over wood, relating to efficiency of manufacture and maintenance, as discussed in the back ground of invention section. Composite and plastic shank butts 20 can be more efficiently produced at a greatly improved accuracy and precision over their wooden counterparts. Additionally, composite material with filler additives provide the capability for increased stiffness of the parts, which is extremely important to the responsiveness and touch weight requirement of any piano. Best mode shank butts 20 are made of 6/6 Nylon with 50% long glass fiber. This material is currently considered the best mode as it yields the best combination of performance, i.e. rigidity, and price. For instance, glass filler is considerably less costly than carbon filler. As the cost of composites or plastics with different filler materials fluctuates with economic trends, a new best mode material will likely be chosen.

All hammer shanks 30 of this invention are essentially cylindrically shaped made from composite or plastic material with an overall outer diameter range of 1-8 mm. Such hammer shanks 30 can be manufactured with less weight and more rigidity than their wooden counterparts. This is particularly so when the hammer shank 30 is made of hollow form because hollow parts naturally weigh less than non-hollow parts. Thus, the best mode hammer shank 30 of this invention is hollow in the center as depicted at 210. The hollow cross section of the shank 30 does not have to be round, but typically is so. Likewise, the outer cross section of the shank 30 does not have to be round, but typically is so. Hollow hammer shanks are typically most efficiently produced by an extrusion process.

Rigidity of a hammer shank 30 can be increased even more so when constructed from materials with additive fiber fillers. Many fiber fillers can be used for this purpose like glass, Kevlar, carbon, or ceramic to increase rigidity. However, in the case of extruded parts, carbon fillers are the best of the aforementioned because carbon fibers tend to tear apart less during the extrusion process as compared to other fillers like glass. As stated above, hollow hammer shanks are better because they weigh less and are most efficiently made by extrusion, thus, carbon fiber filler has been chosen as the best mode for the composite hammer shank 30. The extra cost of carbon fiber is required to combat the fiber breakdown problem associated with glass fiber extrusions.

Figure 3:
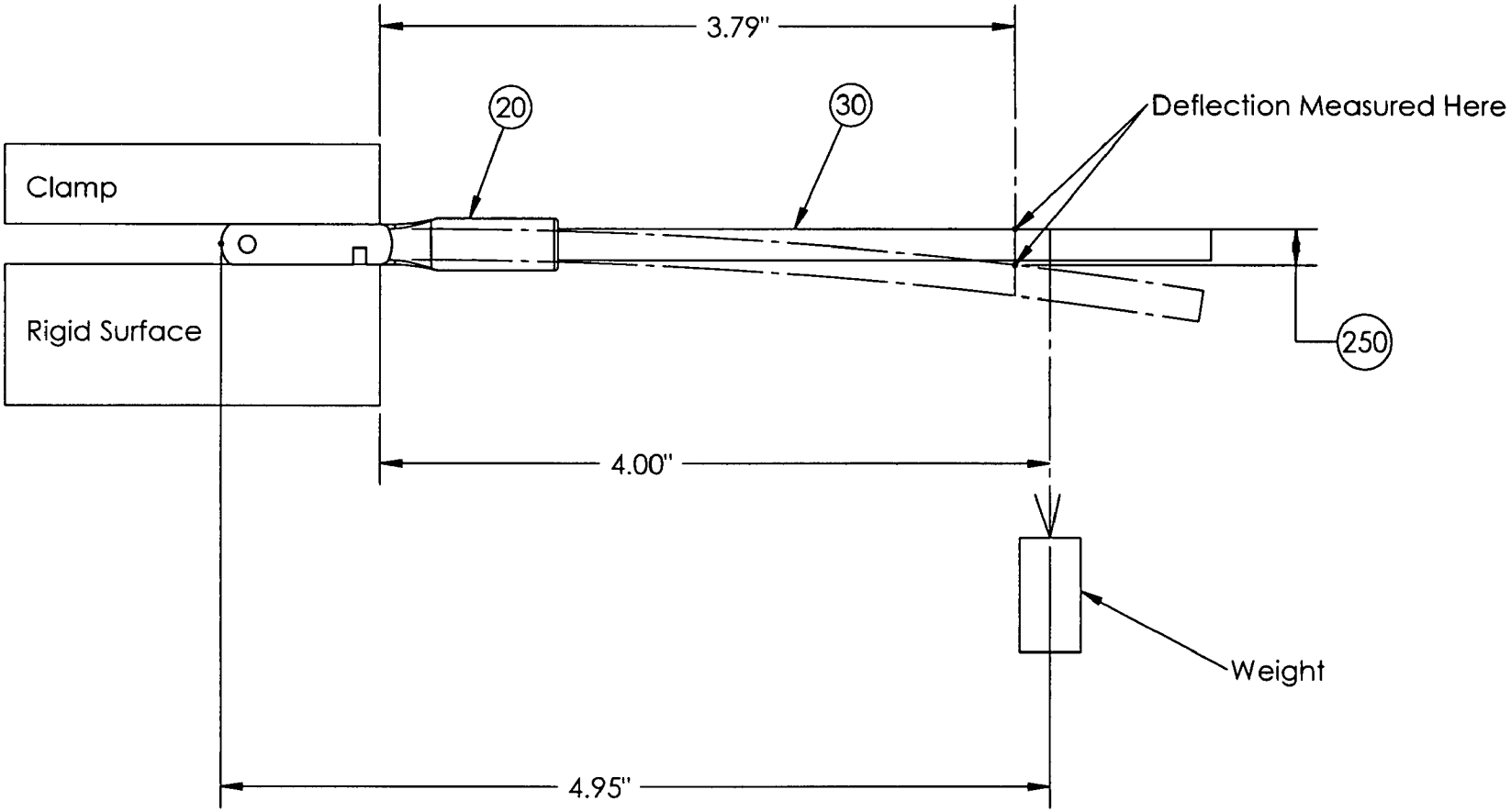
FIG. 3 is a side view of the experimental setup used to measure hammer shank rigidity.
Figure 4:
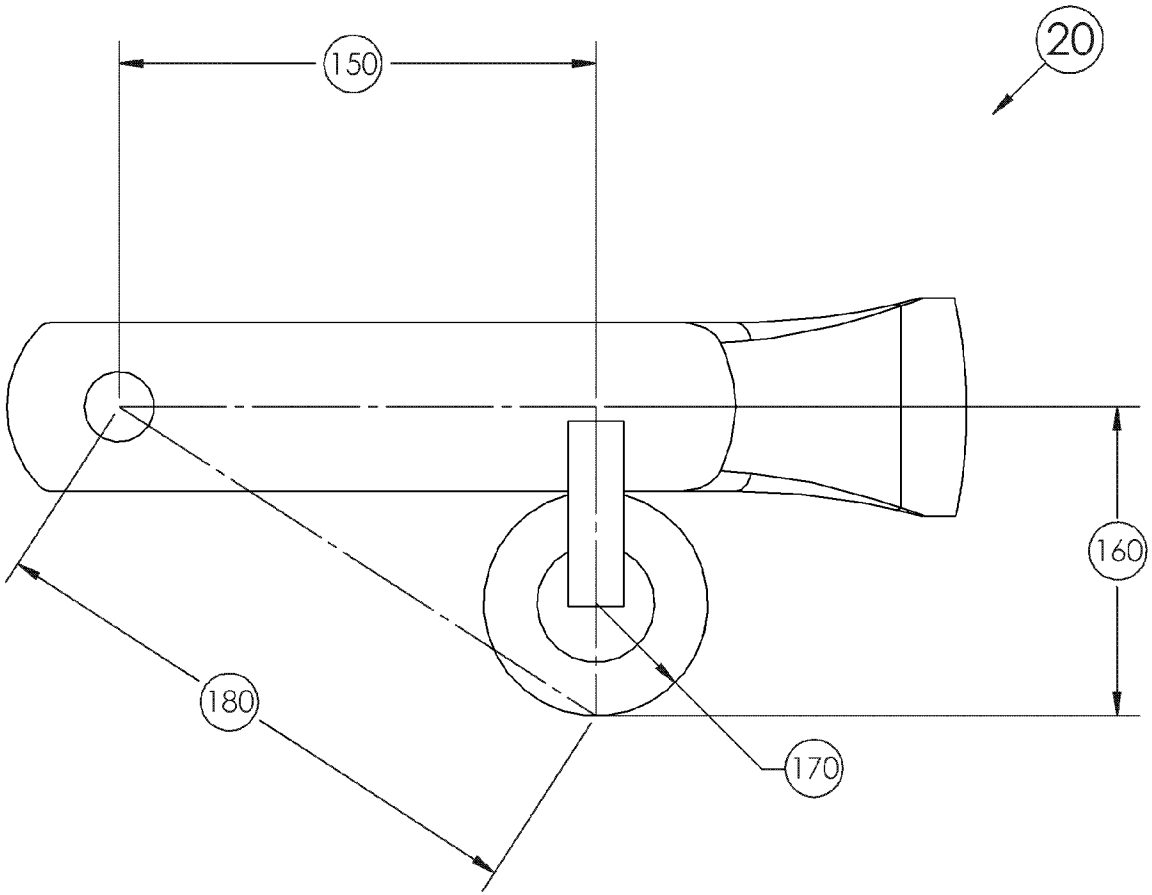
FIG. 4 is a magnified view of one end of a grand piano shank butt.
Figure 5:
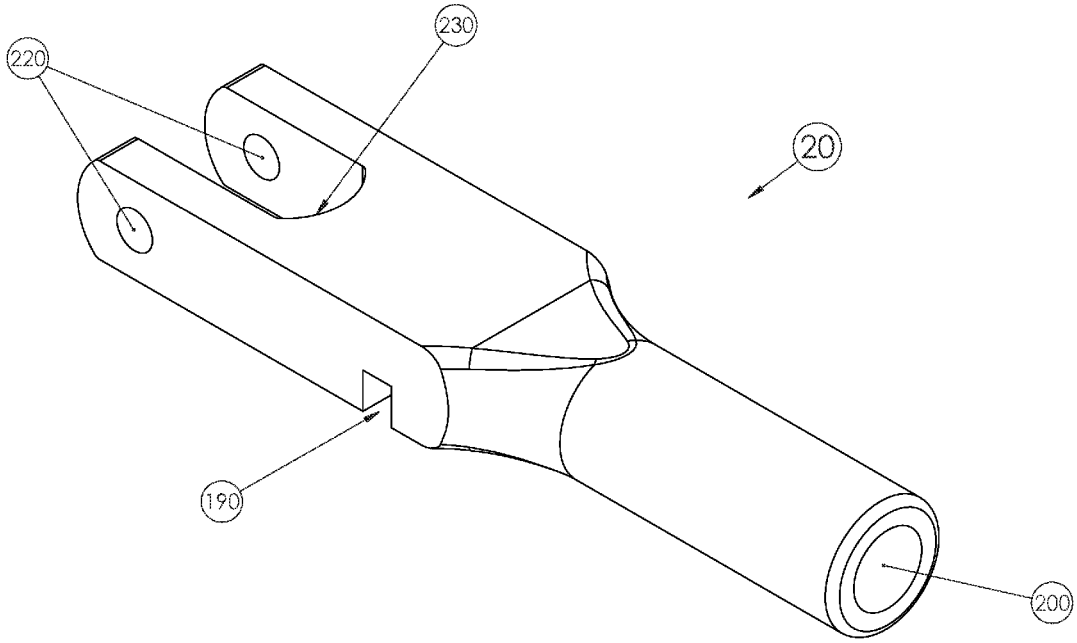
FIG. 5 is a perspective view of a grand piano shank butt.
Figure 6:
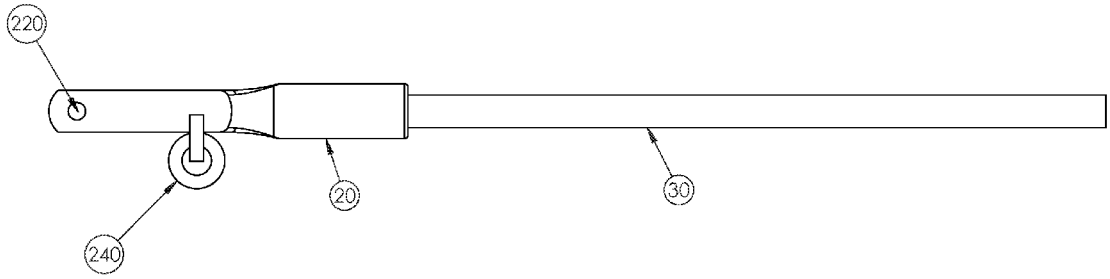
FIG. 6 is a side view is a grand piano hammer shank/shank butt assembly.
Figure 7:
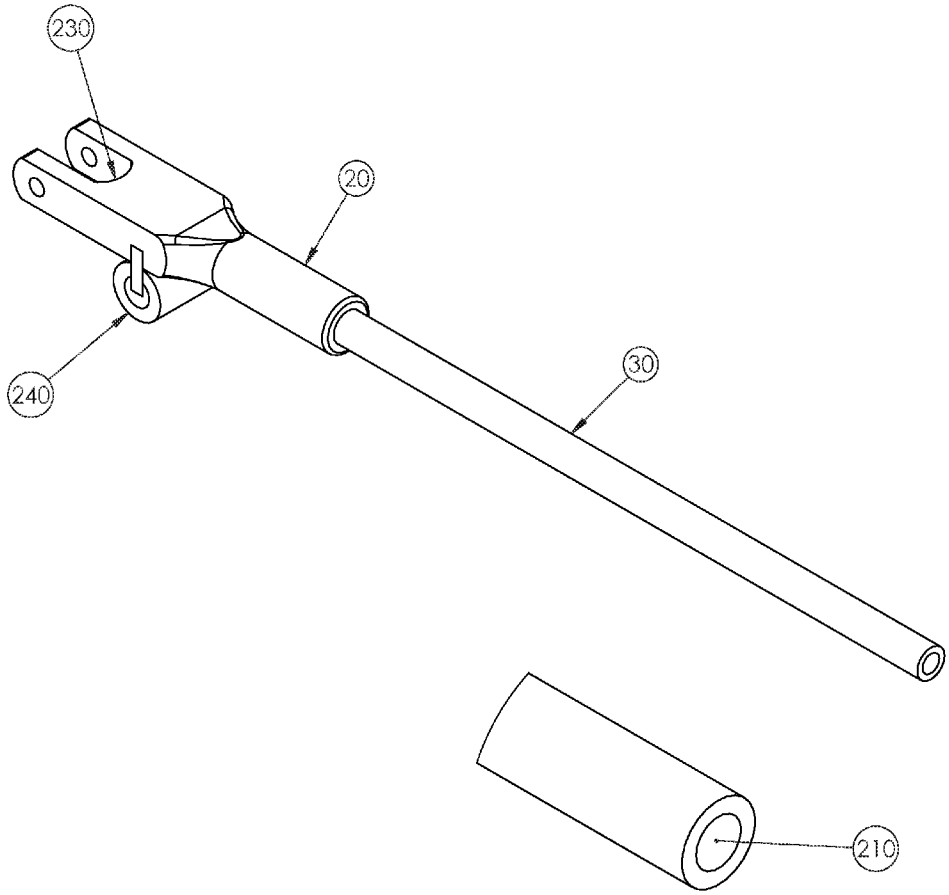
FIG. 7 is a perspective view of a grand piano hammer shank/shank butt assembly.

The applicants have conducted experimental analysis to determine the rigidity of the best mode hammer shank 30. As with the prior art experimental analysis, a hammer shank/shank butt (20 and 30) was clamped tight and secure on the shank butt end while weight was applied at 4.00" from the clamping point. A 4" length of hammer shank 30 was used as this length is typical for both grand piano and upright piano hammer shank/shank butt assemblies or integrated hammer shanks. Deflection 250 was measured at 3.79" from the clamping point. Deflection 250 from various weights was recorded. See FIG. 3 for a depiction of the setup used to quantify the rigidity of the best mode hammer shank 30. The results of the deflection experiment are summarized in the table below.

Best Mode Hammer Shank/Shank Butt Assembly Rigidity Test

| Weight Applied (lbs) | "Thick" Composite Average Deflection (inches) | "Medium" Composite Average Deflection (inches) |
|---|---|---|
| 0 | 0 | 0 |
| 1.0 | 0.028 | 0.050 |
| 2.0 | 0.061 | 0.102 |
| 3.0 | 0.094 | 0.154 |
| 4.0 | 0.128 | 0.207 |
| 5.0 | 0.162 | 0.262 |
| 6.0 | 0.197 | 0.316 |

The relationship is linear, i.e. deflection 250 varies linearly in relation to the change in weight applied. Thus, the degree of deflection, which is inversely proportional to rigidity, of the hammer shank 30 may be represented by a constant. In this case, the constant is given in the units of inches of deflection per pound of weight applied and is determined by dividing the deflection number by the weight number listed above. The degree of deflection 250, defined as "deflectability", of the best mode hammer shanks 30 going from thick to medium is 0.031 in/lbs and 0.052 in/lbs respectively. The standard deviation of these measurements is less than 0.0017 in/lbs in all cases. Note the smaller this measurement, the greater the rigidity of the hammer shank 30. Thus, the best mode "thick" hammer shank 30 achieved an increase in rigidity over the prior art counterparts by 53%. The best mode "medium" hammer shank 30 achieved an increase in rigidity over the prior art counterparts by 14%.

Since the best mode hammer shank 30 has a hollow center, a thicker overall hammer shank 30 diameter may be used without a significant weight increase, as compared to that of prior art hammer shanks 30. Taking this into account, it is feasible to use the "thick" diameter composite hammer shank 30 for every key in the piano, without sacrificing hammer shank weight limitations. Thus, instead of using three diameters of hammer shanks 30 in any one piano, all "thick" diameter composite hammer shanks 30 may be used throughout. If the invention is used in this capacity, the new hammer shank 30 can be used to increase rigidity by 52%, 48%, and 60% over the prior art thick, medium, and thin horn beam integrated hammer shanks respectively. This is a very substantial improvement in rigidity of these assemblies that was achieved without increasing weight.

What is claimed is:

1. A hammer assembly for a grand piano that is pivotally moved with the depression of a piano key, comprising:

a hammer;

a hammer shank; and a shank butt, wherein said shank butt further comprises:

a hammer shank hole (200), a knuckle slot (190), a set of two flange attachment holes (220), and a void area (230);

wherein, said hammer shank is elongated having first and second ends where said first end is affixed to said shank butt by insertion inside said hammer shank hole and said second end is affixed in a usual way to said hammer of traditional type; and said flange attachment holes receive there through a hinge pin where said hinge pin is connected to a shank flange of a grand piano, to create a pivotal connection between said shank butt and the shank flange, and said hollow area is required as clearance for the pivotal action between said shank butt and the shank flange.

2. A hammer assembly as recited in claim 1, wherein said hammer shank has a hollow longitudinal center.

3. A hammer assembly as recited in claim 1, wherein said hammer shank and said shank butt are affixed together by glue, epoxy, plastic welding, sonic welding, or over-molding.

4. A hammer assembly for a grand piano as recited in claim 1 wherein said hammer shank and said shank butt are made of plastic or composite material.

5. A shank butt for a grand piano as recited in any of the preceding claims that is made of Nylon plastic with 40-60% glass fiber filler material.

* * * * *